United States Patent [19]

Singhal et al.

[11] Patent Number: 4,602,950

[45] Date of Patent: Jul. 29, 1986

[54] PRODUCTION OF FERROBORON BY THE SILICON REDUCTION OF BORIC ACID

[75] Inventors: Subhash C. Singhal, Murrysville Boro; David M. Moon, Pittsburgh, both of Pa.

[73] Assignee: Westinghouse Electric Corp., Pittsburgh, Pa.

[21] Appl. No.: 775,074

[22] Filed: Sep. 12, 1985

[51] Int. Cl.[4] ..... C22C 33/00

[52] U.S. Cl. ..... 75/133; 75/129; 75/133.5

[58] Field of Search ..... 75/129, 133, 133.5

[56] References Cited

U.S. PATENT DOCUMENTS

| | | | |
|---|---|---|---|
| 4,297,135 | 10/1981 | Giessen | 75/129 |
| 4,397,691 | 8/1983 | Hamada | 75/123 B |
| 4,440,568 | 4/1984 | Staggers | 75/129 |
| 4,486,226 | 12/1984 | Hildebrand | 75/129 |
| 4,509,976 | 4/1985 | Zambrano | 75/129 |
| 4,536,215 | 8/1985 | Coad | 75/129 |

*Primary Examiner*—Peter D. Rosenberg
*Attorney, Agent, or Firm*—R. D. Fuerle

[57] ABSTRACT

This is a process for producing a ferroboron containing 0.5–20% silicon and up to 4.5% carbon. This process utilizes the silicon reduction of $B_2O_3$ and avoids excessive losses due to volatilization of $B_2O_3$. It also results in a ferroboron which is substantially free from aluminum impurity. The process uses a mixture, which includes an iron-containing constituent, a silicon containing constituent, and boric acid. Preferably a molten pool is prepared and controlled to a temperature of 1100–1550 (and preferably 1100°–1450° C.) prior to the addition of the boric acid. At least some of the silicon constituent can also be injected into the molten pool along with the boric acid.

8 Claims, No Drawings

PRODUCTION OF FERROBORON BY THE SILICON REDUCTION OF BORIC ACID

CROSS-REFERENCE TO RELATED APPLICATIONS

A method for producing a composition for an amorphous iron-boron-silicon-carbon alloy by means of carbon reduction of boric acid is described in related Application Ser. No. 06/775,205 assigned to the same assignee. Although the end product may be the same amorphous alloy, the process of that related case uses carbon reduction, rather than silicon reduction as in the instant invention, and also produces the final composition, rather than an intermediate composition as in the instant invention.

A method for producing an amorphous alloy composition by means of silicon reduction is described in related Application Ser. No. 06/775,075 assigned to the same assignee. Although both that related case and the instant invention use silicon reduction, the process of that related case produces the final alloy, rather than the intermediate ferroboron of the instant invention. It should be noted that both of these related applications produce the final compositions for amorphous alloys and are eventually rapidly cooled to produce an amorphous structure (but may be stored temporarily as master alloy).

BACKGROUND OF THE INVENTION

The present invention relates to a process for making ferroboron, and in particular a ferroboron which contains some silicon, but is substantially free of aluminum.

In the past, aluminum-free ferroboron has been expensive. While aluminum containing ferroboron has been satisfactory for many applications, some applications (and particularly processes for producing amorphous magnetic alloy) cannot generally use such aluminum containing ferroboron.

Amorphous alloys, such as an iron-3% boron-5% silicon (typically also containing about 0.5% carbon) have been suggested for a number of magnetic applications, such as in motors and transformers. Such alloys have been relatively expensive, however, principally due to the cost of aluminum-free boron. The boron content for such magnetic alloys typically has been added in the form of ferroboron which has been prepared by carbon reduction of a mixture of $B_2O_3$, steel scrap, and/or iron oxide (mill scale). That process for making ferroboron is highly endothermic and is typically carried out in submerged electrode arc furnaces. The reduction requires temperatures of about 1600°–1800° C. and the boron recovery is low (typically only about 40%, and thus about 2.5 times the final amount of boron must be added) due to the very high vapor pressue of $B_2O_3$ at such high reaction temperatures. Furthermore, large amounts of carbon monoxide gas are evolved during the process, necessitating extensive pollution control. Low recovery of boron and the use of extensive pollution control equipment result in a high cost of converting $B_2O_3$ (anhydrous boric acid) into ferroboron. Such ferroboron typically costs more than 5 times as much as boric acid per pound of contained boron.

Although boric acid can be reduced by an aluminothermic process, such as a process produces ferroboron with about 4% aluminum which, although suitable for some applications, is unsuitable for use in magnetic applications.

SUMMARY OF THE INVENTION

This is a process for producing a substantially aluminum-free ferroboron. This ferroboron contains 10–25% by weight boron, 0.5–20% silicon and up to about 4.5% carbon, with the remainder being iron and incidental impurities. Anhydrous boric acid ($B_2O_3$) is reduced principally by silicon. The process comprises preparing a mixture consisting essentially of an iron constituent, a silicon constituent, and anhydrous boric acid. The iron constituent is selected from the group consisting of iron, iron oxide, ferrosilicon, and mixtures thereof. The silicon constituent is selected from the group consisting of silicon, ferrosilicon, and mixtures thereof. The weight percent of silicon in the mixture is between about 2 and 3.7 times the weight of boron in the mixture. The mixture is reacted at a temperature of 1100°–1550° C. to produce molten iron containing 10–25% boron, 0.5–20% silicon, and up to 5% of one of the aforementioned alloying agents. The molten pool is covered by a silicon dioxide containing slag.

Preferably a molten pool containing at least the iron constituent is controlled to a temperature of 1100°–1450° C. (the addition of some carbon or silicon or both allows the bath to remain molten at lower temperatures than a pure iron bath) prior to the addition of the boric acid and preferably, at least some of the silicon constituent is injected into the molten pool along with boric acid.

The combination of the lower temperature of the molten pool and the ready availability of silicon for reducing the $B_2O_3$ results in less of the boron content being lost.

DESCRIPTION OF THE PREFERRED EMBODIMENTS

In this invention $B_2O_3$ (boric acid, as a dry powder, preferably anhydrous technique grade) is reduced by silicon in a pool of molten iron (generally at a temperature of 1100°–1550° C.) to produce a substantially aluminum-free, silicon containing ferroboron alloy. The reaction of silicon and boric acid, according to the following reaction is thermodynamically favored, and thus little or no external heat is necessary:

$$2B_2O_3+3Si \rightarrow 4B+3SiO_2$$

The silicon dioxide forms a slag on the surface and can be easily removed. The reaction can be carried out in electric furnace to assure that heat, if necessary, can be added to assure good slag-metal separation.

This approach minimizes the required amount of boron and avoids aluminum contamination.

The silicon can be added either as ferrosilicon or silicon metal or mixtures thereof. The iron can be added as iron (including, for example, carbon containing iron, such as pig iron), iron oxide, ferrosilicon, and mixtures thereof. It should be noted that inexpensive iron oxide can be used to add some of the iron as the bath is highly reducing. Carbon can also be added as carbon, carbon as iron (e.g. in pig iron) or mixtures thereof. The foregoing compounds are preferred as being the most practical way to add the constituents.

For some applications, such as amorphous brazing alloys, other constituents of the final alloy can be added at least in part in the ferroboron of this alloy. Further, other additives which will slag off (including excess phosphorous) or which will bubble off (including excess carbon) either directly, or when oxidized, can be included. Thus some carbon, for example, may be included, even for use with amorphous alloys which contain no carbon, as the carbon can be oxidized and generally removed from the bath. This is especially true as moderate carbon impurity levels in such amorphous magnetic alloys is generally not a problem.

The reduction of boron is principally by silicon, especially at preferred temperature of less than 1500° C. as the reaction $B_2O_3+3C \rightarrow 2B+3CO$ is not thermodynamically favored at such temperatures.

Typically, the desired ferroboron will contain between 10 and 20 wt.% boron. The amount of silicon required to reduce the boron is approximately twice the weight of the boron and generally any additional silicon added will remain in the ferroboron. Adding additional silicon tends to reduce the loss of boron due to volatilization of the boric acid, reduces the temperature necessary to keep the bath molten, and of course, results in a higher silicon content in the ferroboron product. Thus if the final product is to contain 3% boron and 5% silicon, the amount of silicon added is preferably about 3.7 times the weight of boron to be produced.

Preferably, the ratio of iron to boron in the ferroboron product is between about 8:1 and 3:1. This is, of course, in terms of elemental boron and does not include boron which is lost through the volatilization of $B_2O_3$.

Preferably, the ferroboron of this process is used as the principal boron supplying ingredient in an amorphous alloy, and preferably the amorphous alloy is an iron-boron-silicon alloy used as at least a portion of the magnetic material for an electrical device such as a transformer or a motor.

While the composition of the mixture may be calculated prior to mixing using stoichiometric iron, between 1–1.75 times stoichiometric boron, and silicon in the amount of 2–3.7 (and preferably 2.5–3.7) times the weight of stoichiometric boron for the desired ferroboron composition, analysis of molten pool chemistry can be made and additions made to adjust the chemistry as required. This is especially convenient as the loss of boron by a volatilization of $B_2O_3$ as well as the usage of silicon in reacting with oxygen from other sources can vary from batch to batch.

The process can be carried out in suitably refractory-lined containers or sand pits in which the well-mixed reactants are smelted together. Silica ($SiO_2$) produced in the reaction forms a slag on top of the ferroboron melt and can be removed. Depending on the actual nature and the amount of reactants used, the amount of heat generated in the silicon reduction may be insufficient to melt the slag and give good slag-metal separation and thus it may be necessary to carry out the process in an electric furnace to provide some additional heat. The ferroboron produced by this process will contain some silicon (at least 0.5%) as such silicothermic reactions generally do not go to completion and excess silicon minimizes the loss through volatilization of $B_2O_3$. However, since silicon is generally not deleterious for most ferroboron applications and since magnetic amorphous alloys typically contain about 5 wt.% silicon, the silicon containing ferroboron is perfectly suitable for introducing boron, as well as at least part of the required silicon in the amorphous alloy. The cost of producing this ferroboron is much lower than the prior art carbothermic reduction process due to the very small capital investment requirements, simplicity of operation, and exothermic nature of the process.

The foregoing description of the invention is to be regarded as illustrative rather than restrictive. The invention is intended to cover all processes which do not depart from the spirit and scope of the invention.

We claim:

1. A process for producing a substantially aluminum-free iron-boron-silicon alloy, said process comprising:

a. preparing a mixture consisting essentially of an iron constituent, a silicon constituent, and boric acid, said iron constituent being selected from the group consisting of iron, iron oxide, ferrosilicon, and mixtures thereof, and said silicon constituent being selected from the group consisting of silicon, ferrosilicon, and mixtures thereof, with the weight percent of silicon in said mixture being between about 2 and 3.7 times the weight percent of boron in said mixture;

b. reacting said mixture at a temperature of 1100°–1550° C. to produce molten iron, 10–25% boron, 0.5–20% silicon pool which contains up to 4.5% carbon and which is covered by a silicon dioxide-containing slag; and c. removing the slag.

2. The process of claim 1, wherein the ratio of iron to elemental boron in said pool is between about 8:1 and 3:1.

3. A process for producing a substantially aluminum-free ferroboron alloy, said process comprising:

a. preparing a mixture consisting essentially of an iron constituent, a silicon constituent, and boric acid, said iron constituent being selected from the group consisting of iron, iron oxide, ferrosilicon, and mixtures thereof, and said silicon constituent being selected from the group consisting of silicon, ferrosilicon, and mixtures thereof with the amount of silicon in said mixture being greater than stoichiometric for forming $SiO_2$ with the amount of oxygen in said mixture;

b. reacting said mixture at a temperature of 1100°–1550° C. to produce molten ferroboron containing 0.5 to 20% silicon and up to 4.5% carbon conveyed by a silicon dioxide-containing slag; and c. removing the slag.

4. The process of claim 3, wherein the ratio of iron to boron in said pool is between 10:1 and 2:1.

5. The process of claim 4, wherein the weight percent of silicon is between 2.5 and 3.7 times the weight percent of boron in said mixture.

6. The process of claim 4, wherein said ferroboron is used as a principal boron-supplying ingredient in an amorphous magnetic alloy.

7. The process of claim 4, wherein at least said iron constituent is heated to produce a molten pool and the temperature of said pool is controlled to 1100°–1450° C. prior to the addition of said boric acid.

8. The process of claim 7, wherein at least some of said silicon constituent is injected into said molten pool along with said boric acid.

* * * * *